US011069500B2

(12) United States Patent
Chao

(10) Patent No.: US 11,069,500 B2
(45) Date of Patent: Jul. 20, 2021

(54) SYSTEM AND METHOD FOR PREVENTING CHATTER ON CONTACTS

(71) Applicant: LEACH INTERNATIONAL CORPORATION, Buena Park, CA (US)

(72) Inventor: Kevin Chao, Buena Park, CA (US)

(73) Assignee: Leach International Corporation, Buena Park, CA (US)

( * ) Notice: Subject to any disclaimer, the term of this patent is extended or adjusted under 35 U.S.C. 154(b) by 158 days.

(21) Appl. No.: 16/540,975

(22) Filed: Aug. 14, 2019

(65) Prior Publication Data

US 2020/0144011 A1 May 7, 2020

Related U.S. Application Data

(60) Provisional application No. 62/755,077, filed on Nov. 2, 2018.

(51) Int. Cl.

| | |
|---|---|
| ***H01H 50/30*** | (2006.01) |
| ***H01H 50/58*** | (2006.01) |
| ***H01H 50/54*** | (2006.01) |
| ***H01H 50/64*** | (2006.01) |

(52) U.S. Cl.

CPC ..... *H01H 50/30* (2013.01); *H01H 50/541* (2013.01); *H01H 50/58* (2013.01); *H01H 50/641* (2013.01); *H01H 50/648* (2013.01); *H01H 2221/062* (2013.01); *H01H 2221/082* (2013.01); *H01H 2225/014* (2013.01)

(58) Field of Classification Search

CPC ..... H01H 50/30; H01H 50/541; H01H 50/58; H01H 50/648; H01H 50/641; H01H 2221/082; H01H 2225/014; H01H 2221/062; H01H 1/50

See application file for complete search history.

(56) References Cited

U.S. PATENT DOCUMENTS 2,444,157 A * 6/1948 Dries ..... H01H 50/30 335/259
3,418,608 A * 12/1968 Angel ..... H01H 51/06 335/131
3,684,986 A * 8/1972 Nagamoto ..... H01H 50/648 335/200

(Continued)

*Primary Examiner* — Mohamad A Musleh
(74) *Attorney, Agent, or Firm* — Lewis Roca Rothgerber Christie LLP

(57) ABSTRACT

A contactor includes a first actuator, a compressive element moveably coupling the first actuator to a rigid portion of the contactor, a shaft configured to move toward the rigid portion when the contactor is in an energized state and to move away from the rigid portion when the contactor is in a de-energized state, a second actuator fixedly coupled to the shaft, and a common contact extending between the first actuator and the second actuator, the common contact being moveable with respect to a first contact, wherein the compressive element is configured to press the first actuator against the common contact, and wherein the first actuator is configured to electrically connect the common contact and the first contact when the contactor is in the de-energized state, and the second actuator is configured to electrically disconnect the common contact and the first contact when the contactor is in the energized state.

20 Claims, 4 Drawing Sheets

(56) References Cited

U.S. PATENT DOCUMENTS

| | | | | |
|---|---|---|---|---|
| 4,216,452 | A * | 8/1980 | Arnoux | H01H 1/26 335/128 |
| 9,543,102 | B2 * | 1/2017 | Tachikawa | H01H 50/54 |
| 2010/0026427 | A1 * | 2/2010 | Moeller | H01H 1/50 335/71 |

* cited by examiner

SYSTEM AND METHOD FOR PREVENTING CHATTER ON CONTACTS

CROSS-REFERENCE TO RELATED APPLICATION(S)

This application claims priority to, and the benefit of, U.S. Provisional Application No. 62/755,077 ("SYSTEM AND METHOD FOR REDUCING CHATTERING ON CONTACTS DURING VIBRATION"), filed on Nov. 2, 2018, the entire content of which is incorporated herein by reference.

FIELD

Aspects of embodiments of the present disclosure are generally related to relays and contactors.

BACKGROUND

Relays and contactors are used extensively in electrical power switching applications. These devices operate with a fairly low power signal and may be capable of switching high levels of power. The principle of operation of these devices is a magnetic circuit that actuates a moving contact and closes the path of the current. The magnetic force may be generated via a coil, and is applied to the moving contact to close the conduction path.

One method of actuating a contact is using the linear displacement force of the magnetic field to move a ferromagnetic material. When the coil is energized, it generates a magnetic force that attracts a ferromagnetic plunger, which is connected to the moving contact. The moving contact is pulled toward and makes intimate contact with stationary contacts, thus closing the conduction path and allowing the current to flow through the device.

Contactors and relays that are designed for critical applications, such as aerospace applications, have stringent requirements for their operating characteristics, which limit acceptable levels of shock and chatter. Chattering is referred to a behavior of the contacts of a relay/contactor that open and close momentarily. Prolonged chattering may have an adverse effect on the contact material and causes their rapid erosion.

The above information disclosed in this Background section is only for enhancement of understanding of the present disclosure, and therefore it may contain information that does not form the prior art that is already known to a person of ordinary skill in the art.

SUMMARY

Aspects of embodiments of the present disclosure are directed to a system and method for eliminating or substantially reducing chatter of contacts of a contactor device.

According to some embodiments of the present disclosure, there is provided a contactor including: a first actuator; a compressive element moveably coupling the first actuator to a rigid portion of the contactor; a shaft configured to move toward the rigid portion when the contactor is in an energized state and to move away from the rigid portion when the contactor is in a de-energized state, the shaft being moveable with respect to the first actuator; a second actuator fixedly coupled to the shaft and spaced from the first actuator; and a common contact extending between the first actuator and the second actuator, the common contact being moveable with respect to a first contact, wherein the compressive element is configured to press the first actuator against the common contact, and wherein the first actuator is configured to electrically connect the common contact and the first contact when the contactor is in the de-energized state, and the second actuator is configured to electrically disconnect the common contact and the first contact when the contactor is in the energized state.

In some embodiments, the shaft is engaged with, and not attached to, the first actuator.

In some embodiments, the first and second actuators are parallel plates extending in a direction crossing an extension direction of the shaft.

In some embodiments, the first contact is a normally-closed contact and includes a first pair of contacts configured to conduct electrical current when the contactor is in the de-energized state.

In some embodiments, the first actuator is configured to maintain a physical and electrical connection between the common contact and the first contact in the presence of vibration of the shaft within a set range.

In some embodiments, the set range is 6 to 8 Grms (root mean square acceleration) at 5 Hz to 2000 Hz vibration levels.

In some embodiments, the contactor further includes: a second contact spaced from the first contact, wherein the contact is between the first contact and the second contact along an extension direction of the shaft.

In some embodiments, the common contact extends between, and contacts at least one of, the first and second actuators.

In some embodiments, the first and second contacts are electrically isolated from one another.

In some embodiments, the first actuator is configured to electrically disconnect the common contact and the second contact when the contactor is in the de-energized state, and the second actuator is configured to electrically connect the common contact and the second contact when the contactor is in the energized state.

In some embodiments, the second contact is a normally-open contact and includes a second pair of contacts configured to conduct electrical current when the contactor is in the energized state.

In some embodiments, the first and second contacts are auxiliary contacts of the contactor and are configured to replicate conduction states of main contacts of the contactor and to indicate the conduction states of the main contacts to a host system.

In some embodiments, the rigid portion is a housing of the contactor.

In some embodiments, the contactor further includes: a shaft driver configured to drive the shaft toward the rigid portion, when the contactor is in the energized state, and to retract the shaft away from the rigid portion when the contactor is in the de-energized state.

In some embodiments, the shaft driver includes: a moveable core coupled to the shaft; and an electromagnetic coil configured to induce a movement in the moveable core in response to a control signal, the control signal being an open or close signal.

According to some embodiments of the present disclosure, there is provided a contactor including: a first actuator; a compressive element moveably coupling the first actuator to a rigid portion of the contactor; a shaft configured to move toward the rigid portion when the contactor is in an energized state and to move away from the rigid portion when the contactor is in a de-energized state, the shaft being moveable with respect to the first actuator; a second actuator fixedly coupled to the shaft and spaced from the first actuator; and a common contact extending between the first actuator and the second actuator, the common contact being between a first contact and a second contact and being moveable with respect to the first and second contacts, wherein the compressive element is configured to press the first actuator against the common contact, and wherein the first actuator is configured to electrically connect the common contact to the first contact and to electrically disconnect the common contact and the second contact when the contactor is in the de-energized state, and the second actuator is configured to electrically disconnect the common contact and the first contact and to electrically connect the common contact to the second contact when the contactor is in the energized state.

In some embodiments, the shaft is engaged with, and not attached to, the first actuator.

In some embodiments, the first actuator is configured to maintain a physical and electrical connection between the common contact and the first contact in the presence of vibration of the shaft within a set range.

In some embodiments, the set range is from 6 to 8 Grms (root mean square acceleration) at 5 Hz to 2000 Hz vibration levels.

In some embodiments, the first and second contacts are auxiliary contacts of the contactor and are configured to replicate conduction states of main contacts of the contactor and to indicate the conduction states of the main contacts to a host system.

BRIEF DESCRIPTION OF THE DRAWINGS

The accompanying drawings, together with the specification, illustrate example embodiments of the present disclosure, and, together with the description, serve to explain the principles of the present disclosure.

DETAILED DESCRIPTION

The detailed description set forth below is intended as a description of example embodiments of a system and method for defect detection, provided in accordance with the present disclosure, and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1A:
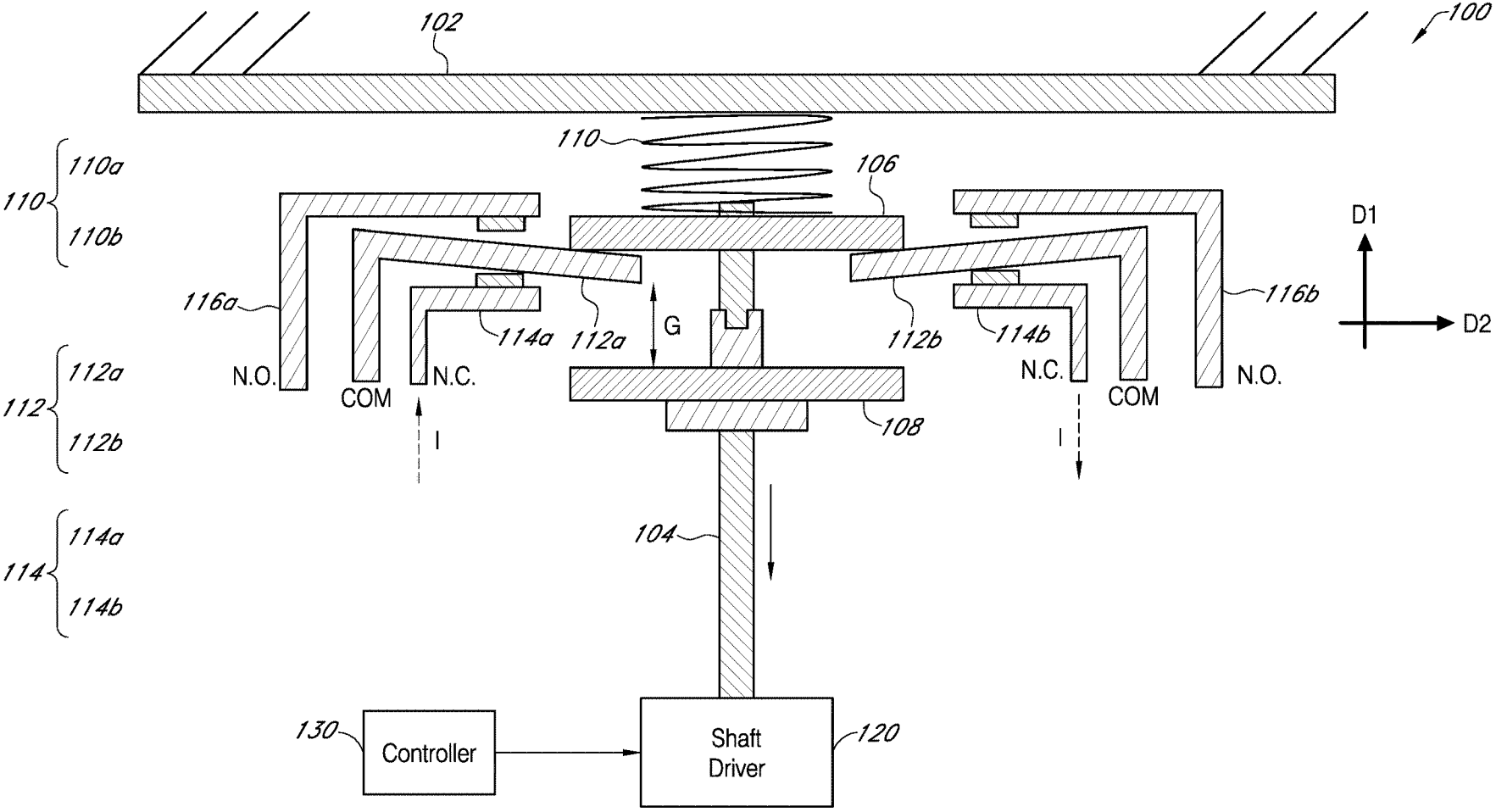
FIGS. 1A-1B illustrate a contactor experiencing vibration in a de-energized state, according to some exemplary embodiments of the present invention.
Figure 1B:
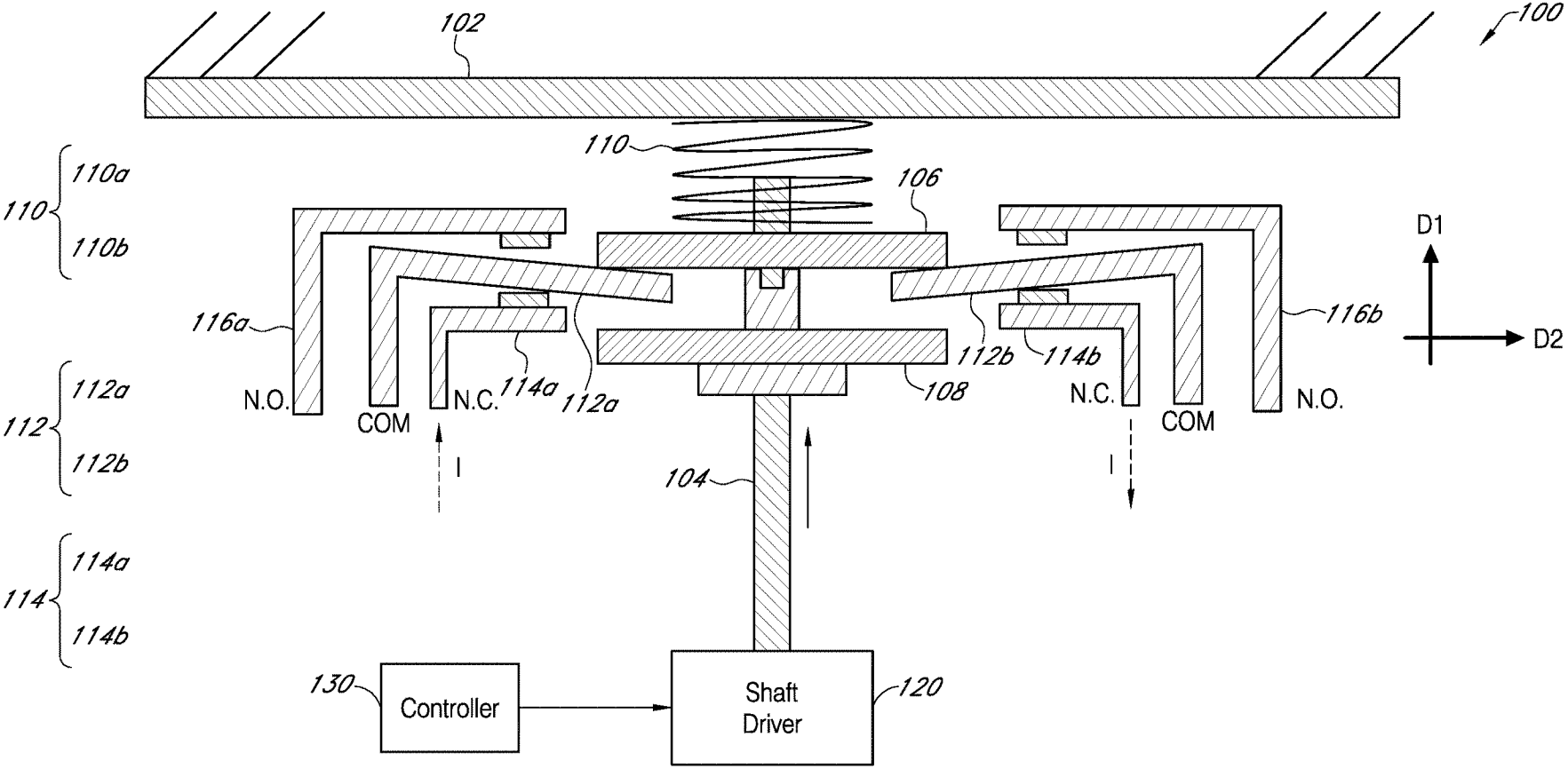
Figure 2:
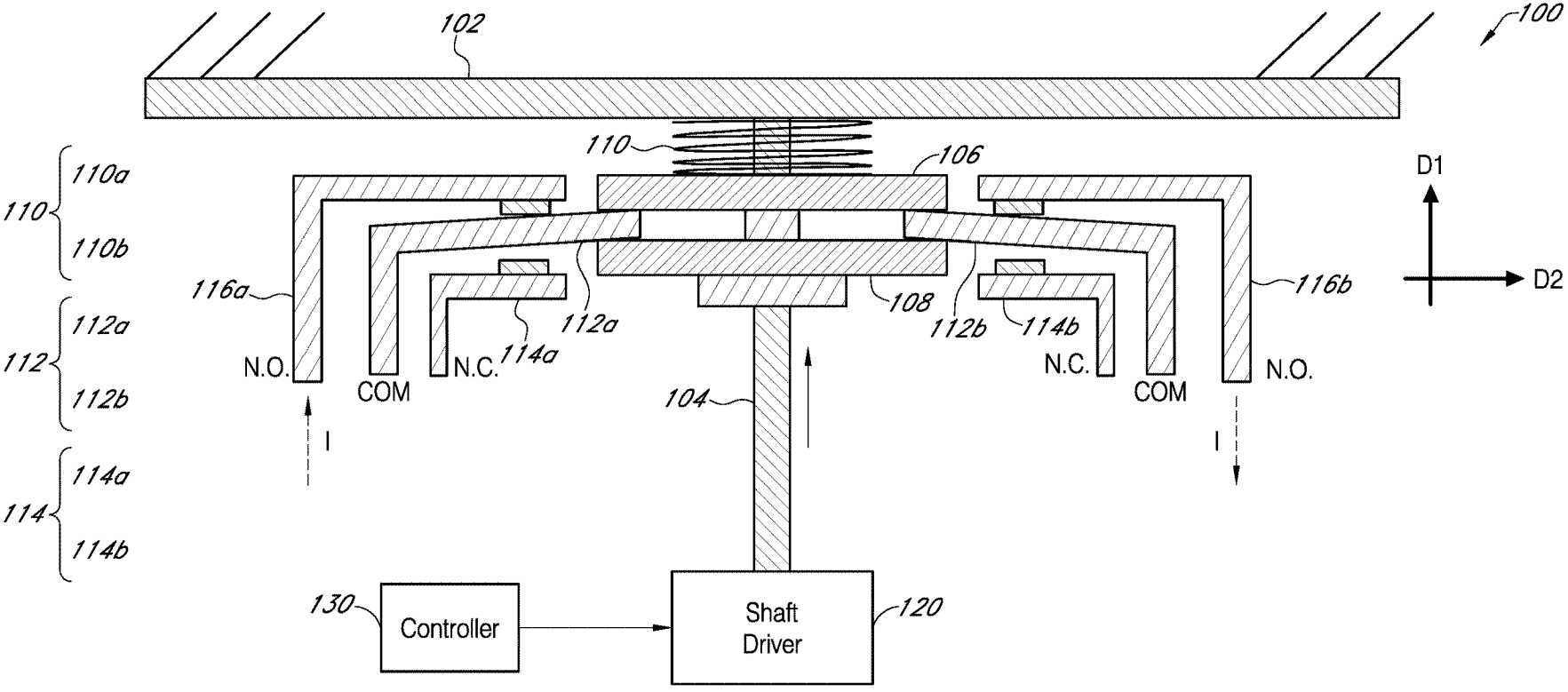
FIG. 2 illustrates the contactor in an energized state, according to some exemplary embodiments of the present invention.

FIGS. 1A-1B illustrate a contactor 100 experiencing vibration in a de-energized state, according to some exemplary embodiments of the present invention. FIG. 2 illustrates the contactor 100 in an energized state, according to some exemplary embodiments of the present invention.

Referring to FIGS. 1A-2, in some embodiments, the contactor 100 includes a rigid portion 102; a shaft 104 that is moveable relative to the rigid portion 102; a first actuator 106 and a second actuator 108 moveable with respect to (e.g., engageably/moveably coupled to) the shaft 104; a compressive element (e.g., a spring) 110 moveably coupling the first actuator 106 to the rigid portion 102; a common contact 112 extending between, and contacting at least one of, the first and second actuators 106 and 108; a first contact 114; and a second contact 116 spaced from, and electrically isolated from, the first contact 114. In some examples, the rigid portion 102 may be a part of a housing encasing the contactor 100, and the first and second actuators 106 and 108 may be parallel plates extending in a direction crossing (e.g., perpendicular to) an extension direction of the shaft 104.

In some embodiments, the first and second contacts 114 and 116 and the common (COM) contact 112 may be arranged along a first direction D1, which corresponds to the extension direction of the shaft 104. The first and second contacts 114 and 116 are stationary (e.g., relative to the rigid portion 102) and the common contact 112 is moveable between, and capable of coming into physical and electrical contact with, either of the first and second contacts 114 and 116, based on the position of the first and second actuators 106 and 108. According to some embodiments, the first contact 114, which may be further away from the rigid portion 102 than the second contact 116, is a normally closed (N.C.) contact, and the second contact 116 is a normally open (N.O.) contact. The common contact 112 and the first and second contacts 114 and 116 may be made of a suitable conductive material, such as silver tin oxide ($AgSnO_2$), and/or the like. In some embodiments, the common contact 112 includes a pair of common contacts 112*a* and 112*b* that are electrically shorted each other, the first contact 114 includes a pair of first contacts 114*a* and 114*b*, and the second contact 116 includes a pair of second contacts 116*a* and 114*b*. The pairs 112*a* and 112*b*, 114*a* and 114*b*, and 116*a* and 116*b* are arranged at opposite sides of the shaft 104 (e.g., along the second direction D2 crossing the first direction D1). When the common contact 112 (e.g., the pair of common contacts 112*a* and 112*b*) comes into contact with the first contact 114 or the second contact 116, an electrical short is created between the pair of first contacts 114*a* and 114*b* or between the pair of second contacts 116*a* and 116*b*, respectively, thus allowing a current I to pass through the corresponding contact.

According to some embodiments, unlike the second actuator 108, which is fixedly mounted to (or attached to) the shaft 104, the first actuator 106 is not fixedly connected to (e.g., not attached to) but engaged by the shaft 104 and may freely move along the length of the shaft 104 (e.g., along the first direction D1). In some examples, the shaft 104 may pass through an opening (e.g., through hole) in the first actuator 106. The first actuator 106 is held in place by the compressive element 110, which may surround a portion of the shaft 104 and may exert a restoring force on the first actuator 106 to push it toward the common contact 112 when compressed. With this scheme, the initial movement of the shaft 104 is not transferred to the first actuator 106. As such, vibrations of the shaft 104 relative to the rigid portion 102 within a particular range may not affect (e.g., may not reduce) the pressure on the common contact 112, thus preventing or substantially reducing chatter. Such particular range may be about 6 to about 8 Grms (root mean square acceleration) at about 5 Hz to about 2000 Hz vibration levels. When a gap G exists between the second actuator 108 and the common contact 112 in the de-energized state, any vibrational displacement of the shaft 104 with respect to the rigid portion 102 that is less than the gap G may not result in any chatter.

The movement of the shaft 104 along the direction D1 may be driven by the shaft driver 120 in response to a control signal from a controller 130. In an energized state, the shaft driver 120 drives the shaft 104 toward the rigid portion 102, and in a de-energized state, the shaft 104 is retracted toward the shaft driver and away from the rigid portion 102.

FIGS. 1A-1B illustrate the contactor 100 in its de-energized state, in which the shaft 104 is in a relaxed/retracted position. In this state, the compressive element 110, which is partially compressed, keeps the common contact 112 and the first contact 114 in their closed position by applying a restoring force on the first actuator 106. Slight movement of the shaft 104 during vibration may not interfere with the first actuator 106, and may not cause it to move. As illustrated in FIG. 1B, even when the shaft 104 is displaced (e.g., moved up) due to a vibrational force, the movement of the shaft 104 does not transfer to the first actuator 106 and may not affect its position, as it is held in place by the restoring force of the compressive element 110. Therefore, because no undue force (e.g., a displacement force opposite that of the restoring force) is applied to the first actuator 106 due to the movement of the shaft 104, the connection between the common and first contacts 112 and 114 is not broken and chatter (i.e., the unintended opening and closing of the connection) is prevented or at least substantially reduced.

FIG. 2 illustrates the contactor 100 in its energized state, in which the shaft 104 is in a displaced/engaged position. When the contactor 100 is energized the movement/displacement of the shaft 104 may be much more prominent than its movement during shock or vibration. The additional movement (toward the rigid portion 102) engages the second actuator 108 to push the common contact 112 away from the first contact 114 and toward the second contact 116 (e.g., the normally open contact). The movement forces the common contact 112 to make contact with and press against the second contact 116 (and electrically connects the pair of second contacts 116*a* and 116*b*). In the energized state, the common contact 112 may contact the first actuator 106, in addition to the second actuator 108, due to the compression resistance exhibited by (i.e., restoring force applied by) the compressive element 110.

Thus, by detaching and moveably coupling the top actuator and the shaft, and utilizing a spring between the top actuator and the rigid member, the contactor according to embodiments of the present invention is capable of eliminating or substantially eliminating chatter during vibration in at least the de-energized state for a desired margin of vibration movements.

Tests conducted with a comparative example illustrate the effectiveness of the contactor, according to embodiments of the invention, in substantially reducing or eliminating contact chatter. The test was conducted with a 115/230 Vac, 3-pole single throw (3PST) switch /contactor rated for 450 A, with eight single-pole double-throw (SPDT) auxiliary contacts. In a comparative example that does not use a compressive element 110 and has a first actuator that is attached to the shaft, all of the normally closed (N.C.) auxiliary contacts chattered when subjected to 6 gRMS (20 Hz.-2 kHz). The same contactor fitted with the compressive element 110 and utilizing a first actuator that is moveably coupled to the shaft, according to some embodiments of the present invention, exceeded 7 gRMS without chatter. Based on the test results, the contactor according to embodiments of the present invention exhibited no chattering in the de-energized and energized states. The comparative example suffered from chattering due to the movement of the top actuator directly connected to the shaft. The contactor according to embodiments of the present invention allows slight shaft movement without causing the movement in the top Actuator, thus mitigating the chatter of the contacts (e.g., auxiliary contacts) in at least their normally closed position.

The contacts illustrated in FIGS. 1A-2 may be part of the main contacts of a contactor or its auxiliary contacts.

Figure 3:
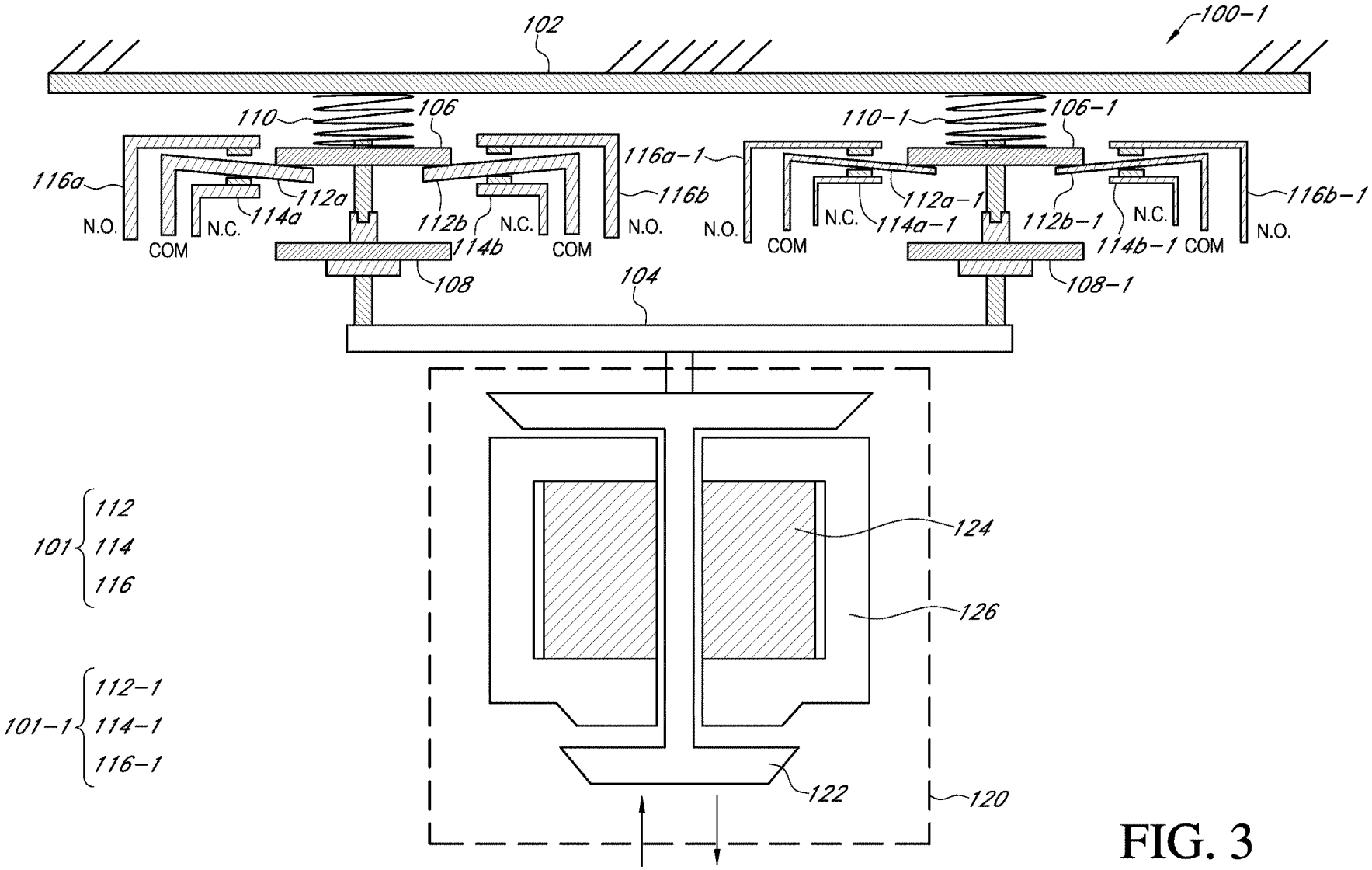
FIG. 3 illustrates a contactor including both main and auxiliary contacts, in a de-energized state, according to some exemplary embodiments of the present invention.

FIG. 3 illustrates a contactor 100-1 including both main contacts 101 and auxiliary contacts 101-1, according to some exemplary embodiments of the present invention. In FIG. 3, elements associated with the auxiliary contacts 101-1, which include a '−1' in their reference numerals, are the same or substantially the same as their corresponding elements associated with the main contacts 101, except as provided below. As such, their corresponding description may not be repeated below.

Referring to FIG. 3, in addition to the main contacts 101, the contactor 100-1 includes auxiliary contacts 101-1 to replicate conduction states (e.g., to indicate the open or close position) of the main contacts 101 to a host system utilizing the contactor 100-1. The auxiliary contacts 101-1 are sized for indication and may be smaller than the main contact as they are rated for lower currents. For example, the auxiliary contacts may be rated for about 5 A to about 10 A, while the main contacts may be rated for about 115 Vac at 450 Aac.

Generally, in any power distribution system utilizing contactors with auxiliary contacts, the integrity of the auxiliary signals generated by the auxiliary contacts may be very critical to system performance, as their incorrect reporting could result in critical, or even catastrophic failures. To assure their compliance with the position of the main contact, the auxiliary contacts are generally driven by the same shaft that actuates the main contacts. Similarly, in the example of the contactor 100-1 illustrated in FIG. 3, the main and auxiliary contacts are both driven by the same shaft 104. In conventional contactors, when the shaft moves it also moves the auxiliary contacts, which could cause the auxiliary contacts to chatter intermittently for microseconds. This is further exacerbated in higher power rating conventional contactors, which utilize more massive moving assemblies and larger contacts to handle the larger current requirements. In such conventional contactors, this increase in mass has an adverse effect on vibration characteristics of the device, i.e., chattering. This problem is further aggravated by multi-pole (3-phase) devices. The increased mass of the moving contacts and their assembly, creates a greater force at resonant frequency, that can overcome the return spring, causing moving of the shaft, and resulting in unwanted chatter.

However, as illustrated in FIG. 2, auxiliary contacts 101-1 of the contactor 100-1 utilize a first actuator 106-1 that is moveably coupled to the shaft 204 and stably presses the common contact 112-1 against the first contact 114-1 of the auxiliary contacts 101-1, even when subject to vibrations of the shaft 204 within a preset range. This, in effect, eliminates or substantially reduces chatter on the auxiliary contacts 101-1.

In the examples, illustrated in FIG. 3, the contactor 100-1 utilizes the modified design of the compressive element 110/110-1 and the shaft-detached first actuator 106/106-1 on both the main contacts 101 and the auxiliary contacts 101-1. However, embodiments of the present invention are not limited thereto, and the modified design, according to some embodiments of the present invention, can be applied to only one of the main contacts 101 and the auxiliary contacts 101-1, for example, only to the auxiliary contacts 101-1.

Further, by eliminating or substantially reducing chatter on contacts, embodiments of the present invention also prevent or substantially prevent arcing, which can improve (e.g., extend) the life of contacts. Generally, when contacts are opened under load (e.g., as a result of chatter) the electron flow across the contacts may be enough to ionize the air molecules across a minimal gap, thus forming an electric arc. The generated plasma may have a low enough electrical resistance to sustain electron flow even with the separation distance between the contacts steadily increasing. The arcing may result in pitting and fretting of the contact material, which in turn results in increased contact resistance and reduced life. However, embodiments of the present invention can readily alleviate this problem, thus improving system reliability and reducing the cost of deploying contactors in power distribution systems.

According to some examples, the contactor 100/100-1 may be a solenoid type contactor, and the shaft 104 may be a part of, or be coupled to, a moveable core (also referred to as a plunger) 122 of a magnet in the shaft driver 120. When an electromagnetic coil 124 of the shaft driver 120 is energized (e.g., in response to the control signal received from the controller 130), the electromagnetic coil 124 generates an electromagnetic force that pushes the movable core toward the rigid portion 102 and away from the stationary core 126. This causes the second actuator 108/108-1, which is mounted to the shaft, to move up and press the common contact 112/112-1 against the second contact 116/116-1, thus closing (e.g., electrically shorting) the second pair of contacts 116*a*/116*a*-1 and 116*b*/116*b*-1 (e.g., the normally open contacts) and allowing the second contact 116/116-1 to conduct current I. At the same time, the first contact 114/114-1 (e.g., the normally closed contacts) open, thus breaking the electrical connection between the first pair of contacts 114*a*/114*a*-1 and 114*b*/114*b*-1. When the electromagnetic coil 124 is de-energized, the shaft 104 returns to its normal/relaxed position (i.e., retracts toward the stationary core 126, which causes the electrical connection between the second pair of contacts 116*a*/116*a*-1 and 116*b*/116-1 to be broken and the electrical connection between the first pair of contacts 114*a*/114*a*-1 and 114*b*/114*b*-1 to be reestablished.

While FIG. 3 illustrates examples in which the shaft driver 120 is of a solenoid type, embodiments of the present invention are not limited thereto, and any suitable shaft driver may be utilized.

While the illustrated embodiments of the present invention utilize both a first contact 114/114-1 (e.g., the normally closed contact) and a second contact 116/116-1 (e.g., the normally open contact), embodiments of the present invention are not limited thereto, and the contactor 100/100-1 may utilize only the first contact 114/114-1 and still benefit from the chatter reducing/eliminating benefits described above with respect to FIGS. 1A-3. Further, while FIG. 3 illustrates one set of main contacts and one set of auxiliary contacts, embodiments of the present invention are not limited thereto, and two or more sets of main contacts and/or two or more sets of auxiliary contacts (and their corresponding actuators) may be utilized that connect to, and are driven by, the same moveable core.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of", when preceding a list of elements, modify the entire list of elements and do not modify the individual elements of the list. Further, the use of "may" when describing embodiments of the inventive concept refers to "one or more embodiments of the inventive concept". Also, the term "exemplary" is intended to refer to an example or illustration.

It will be understood that, although the terms "first", "second", "third", etc., may be used herein to describe various elements, components, and/or sections, these elements, components, and/or sections should not be limited by these terms. These terms are used to distinguish one element, component, or section from another element, component, or section. Thus, a first element, component, or section discussed below could be termed a second element, component, or section, without departing from the scope of the inventive concept.

It will be understood that when an element is referred to as being "connected to" or "coupled to " another element, it can be directly connected to or coupled to the other element, or one or more intervening elements may be present. When an element is referred to as being "directly connected to" or "directly coupled to" another element, there are no intervening elements present.

As used herein, the terms "use", "using", and "used" may be considered synonymous with the terms "utilize", "utilizing", and "utilized", respectively.

The controller and/or any other relevant devices or components according to embodiments of the present disclosure described herein may be implemented by utilizing any suitable hardware, firmware (e.g., an application-specific integrated circuit), software, or a suitable combination of software, firmware, and hardware. For example, the various components of the independent multi-source display device may be formed on one integrated circuit (IC) chip or on separate IC chips. Further, the various components of the controller may be implemented on a flexible printed circuit film, a tape carrier package (TCP), a printed circuit board (PCB), or formed on the same substrate. Further, the various components of the controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer-readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present disclosure.

While this disclosure has been described in detail with particular references to illustrative embodiments thereof, the embodiments described herein are not intended to be exhaustive or to limit the scope of the disclosure to the exact forms disclosed. Persons skilled in the art and technology to which this disclosure pertains will appreciate that alterations and changes in the described structures and methods of assembly and operation can be practiced without meaningfully departing from the principles, and scope of this disclosure, as set forth in the following claims and equivalents thereof.

What is claimed is:

1. A contactor comprising:

a first actuator;

a compressive element moveably coupling the first actuator to a rigid portion of the contactor;

a shaft configured to move toward the rigid portion when the contactor is in an energized state and to move away from the rigid portion when the contactor is in a de-energized state, the shaft being moveable with respect to the first actuator;

a second actuator fixedly coupled to the shaft and spaced from the first actuator; and a common contact extending between the first actuator and the second actuator, the common contact being moveable with respect to a first contact, wherein the compressive element is configured to press the first actuator against the common contact, and wherein the first actuator is configured to electrically connect the common contact and the first contact when the contactor is in the de-energized state, and the second actuator is configured to electrically disconnect the common contact and the first contact when the contactor is in the energized state.

2. The contactor of claim 1, wherein the shaft is engaged with, and not attached to, the first actuator.

3. The contactor of claim 1, wherein the first and second actuators are parallel plates extending in a direction crossing an extension direction of the shaft.

4. The contactor of claim 1, wherein the first contact is a normally-closed contact and comprises a first pair of contacts configured to conduct electrical current when the contactor is in the de-energized state.

5. The contactor of claim 1, wherein the first actuator is configured to maintain a physical and electrical connection between the common contact and the first contact in the presence of vibration of the shaft within a set range.

6. The contactor of claim 5, wherein the set range is 6 to 8 Grms (root mean square acceleration) at 5 Hz to 2000 Hz vibration levels.

7. The contactor of claim 1, further comprising:

a second contact spaced from the first contact, wherein the common contact is between the first contact and the second contact along an extension direction of the shaft.

8. The contactor of claim 7, wherein the common contact extends between, and contacts at least one of, the first and second actuators.

9. The contactor of claim 7, wherein the first and second contacts are electrically isolated from one another.

10. The contactor of claim 7, wherein the first actuator is configured to electrically disconnect the common contact and the second contact when the contactor is in the de-energized state, and the second actuator is configured to electrically connect the common contact and the second contact when the contactor is in the energized state.

11. The contactor of claim 7, wherein the second contact is a normally-open contact and comprises a second pair of contacts configured to conduct electrical current when the contactor is in the energized state.

12. The contactor of claim 7, wherein the first and second contacts are auxiliary contacts of the contactor and are configured to replicate conduction states of main contacts of the contactor and to indicate the conduction states of the main contacts to a host system.

13. The contactor of claim 1, wherein the rigid portion is a housing of the contactor.

14. The contactor of claim 1, further comprising:

a shaft driver configured to drive the shaft toward the rigid portion, when the contactor is in the energized state, and to retract the shaft away from the rigid portion when the contactor is in the de-energized state.

15. The contactor of claim 14, wherein the shaft driver comprises:

a moveable core coupled to the shaft; and an electromagnetic coil configured to induce a movement in the moveable core in response to a control signal, the control signal being an open or close signal.

16. A contactor comprising:

a first actuator;

a compressive element moveably coupling the first actuator to a rigid portion of the contactor;

a shaft configured to move toward the rigid portion when the contactor is in an energized state and to move away from the rigid portion when the contactor is in a de-energized state, the shaft being moveable with respect to the first actuator;

a second actuator fixedly coupled to the shaft and spaced from the first actuator; and a common contact extending between the first actuator and the second actuator, the common contact being between a first contact and a second contact and being moveable with respect to the first and second contacts, wherein the compressive element is configured to press the first actuator against the common contact, and wherein the first actuator is configured to electrically connect the common contact to the first contact and to electrically disconnect the common contact and the second contact when the contactor is in the de-energized state, and the second actuator is configured to electrically disconnect the common contact and the first contact and to electrically connect the common contact to the second contact when the contactor is in the energized state.

17. The contactor of claim 16, wherein the shaft is engaged with, and not attached to, the first actuator.

18. The contactor of claim 16, wherein the first actuator is configured to maintain a physical and electrical connection between the common contact and the first contact in the presence of vibration of the shaft within a set range.

19. The contactor of claim 18, wherein the set range is from 6 to 8 Grms (root mean square acceleration) at 5 Hz to 2000 Hz vibration levels.

20. The contactor of claim 16, wherein the first and second contacts are auxiliary contacts of the contactor and are configured to replicate conduction states of main contacts of the contactor and to indicate the conduction states of the main contacts to a host system.

* * * * *